US009181501B2

(12) United States Patent
Vaidyanathan et al.

(10) Patent No.: US 9,181,501 B2
(45) Date of Patent: Nov. 10, 2015

(54) METHOD AND APPARATUS FOR REMOVING $H_2S$ AND MOISTURE FROM FRACTIONATOR OVERHEAD NAPHTHA

(75) Inventors: Krishnan Vaidyanathan, Cochin (IN); Venkat Ram Naidu Pandranki, Gurgoan (IN)

(73) Assignee: UOP LLC, Des Plaines, IL (US)

( * ) Notice: Subject to any disclaimer, the term of this patent is extended or adjusted under 35 U.S.C. 154(b) by 57 days.

(21) Appl. No.: 13/588,065

(22) Filed: Aug. 17, 2012

(65) Prior Publication Data

US 2014/0048446 A1 Feb. 20, 2014

(51) Int. Cl.

| | |
|---|---|
| ***C10G 31/00*** | (2006.01) |
| ***C10G 70/06*** | (2006.01) |
| ***C10G 70/04*** | (2006.01) |

(52) U.S. Cl.

CPC ..... *C10G 70/06* (2013.01); *C10G 70/041* (2013.01); *C10G 2300/1044* (2013.01); *C10G 2300/207* (2013.01)

(58) Field of Classification Search

CPC ..... C10G 49/22; C10G 7/00; C10G 35/00; C10G 70/06; C10G 70/041; C10G 2300/1044; C10G 2300/207

USPC ..... 208/95, 97, 100, 102, 103, 105, 212; 210/767, 806; 423/563, 564

See application file for complete search history.

(56) References Cited

U.S. PATENT DOCUMENTS

| | | | | |
|---|---|---|---|---|
| 2,048,241 | A * | 7/1936 | Youker | 208/208 R |
| 3,215,619 | A | 11/1965 | Brooke | |
| 3,356,608 | A * | 12/1967 | Franklin | 208/212 |
| 3,733,260 | A * | 5/1973 | Davies et al. | 208/212 |
| 4,199,440 | A * | 4/1980 | Verachtert | 208/230 |
| 4,225,415 | A | 9/1980 | Mirza et al. | |
| 4,231,768 | A | 11/1980 | Seibert et al. | |
| 5,164,070 | A * | 11/1992 | Munro | 208/60 |
| 6,858,128 | B1 * | 2/2005 | Hoehn et al. | 208/111.3 |
| 7,119,244 | B2 | 10/2006 | Smith, Jr. | |
| 7,381,309 | B1 | 6/2008 | Laricchia et al. | |
| 2004/0040889 | A1 | 3/2004 | Groten | |
| 2010/0242362 | A1 | 9/2010 | Van Amelsvoort et al. | |
| 2012/0145594 | A1 | 6/2012 | Hoehn et al. | |

FOREIGN PATENT DOCUMENTS

| | | | |
|---|---|---|---|
| CA | 2567701 | A1 | 12/2005 |
| CN | 1803739 | B | 4/2011 |
| GB | 763625 | A | 12/1956 |

OTHER PUBLICATIONS

Alky-unit operators trade know-how, National Petroleum Refiners Assoc., Oil Gas J. v 78, n 28, pp. 160-162, 164-165, Jul. 14, 1980.

* cited by examiner

*Primary Examiner* — Prem C Singh
*Assistant Examiner* — Brandi M Doyle
(74) *Attorney, Agent, or Firm* — James C. Paschall

(57) ABSTRACT

Methods and apparatus for making naphtha substantially free of $H_2S$ are described. The method includes stripping an incoming stream containing naphtha and $H_2S$ in a fractionator into at least an overhead stream containing the naphtha and $H_2S$ and a bottoms stream, and introducing the overhead stream from the fractionator into a separator to form a naphtha stream substantially free of $H_2S$ and an overhead stream containing $H_2S$.

15 Claims, 2 Drawing Sheets

METHOD AND APPARATUS FOR REMOVING $H_2S$ AND MOISTURE FROM FRACTIONATOR OVERHEAD NAPHTHA

FIELD OF THE INVENTION

This invention relates generally to fractionation columns, and more particularly, to apparatus and methods for removing $H_2S$ and moisture from the naphtha overhead of a fractionator.

BACKGROUND OF THE INVENTION

Hydrocarbon feeds can be reacted in a hydroprocessing zone where a number of reactions take place, including hydrocracking, hydrotreating, hydrogenation, and desulfurization. The hydroprocessing zone is typically followed by a stripper column, where the hydroprocessing zone effluent is separated into a stripper overhead stream and a stripper bottoms stream. In some processes, the stripper column bottoms is sent to a fractionation column, where it is separated into a fractionation column bottoms stream and a naphtha overhead stream. Other streams, such as light gas oil and heavy gas oil streams, can also be separated out in the fractionator, if desired. The naphtha overhead stream is recovered. The naphtha overhead stream includes naphtha, $H_2S$, and, in some cases, water.

The $H_2S$ generated during desulfurization reactions in the hydroprocessing zone is removed predominantly in the stripper column. Although the stripper column is designed to remove $H_2S$ to the level of parts per billion (ppb) in the stripper bottoms stream, small amounts of $H_2S$ slip through into the fractionator. The $H_2S$ becomes concentrated to a level of parts per million (ppm) in the fractionator overhead liquid stream. ASTM D-4952-09 (Doctor Test) is often used as an indicator for the presence of $H_2S$ in the overhead naphtha stream. An $H_2S$ level of 1 weight ppm (wppm) can result in the naphtha not meeting the Doctor Test. If the naphtha does not meet the Doctor Test, it cannot be sent directly to the naphtha pool for storage. Consequently, the $H_2S$ must be removed from the naphtha overhead stream using a secondary processing system.

In many units, the $H_2S$ is removed using a caustic (NaOH) wash and a sand filter. However, many refiners do not want to use caustic because of the hazards associated with handling it and problems related to disposing of the spent caustic.

Alternatively, the naphtha may be sent to a downstream stabilizer/splitter combination for removal of light petroleum gas. The $H_2S$ can be removed along with the light petroleum gas. However, this equipment increases the cost of the process.

Therefore, it would be desirable to provide alternative processes for removing $H_2S$ from naphtha.

SUMMARY OF THE INVENTION

One aspect of the present invention relates to a method of making naphtha substantially free of $H_2S$. In one embodiment, the method includes stripping an incoming stream containing naphtha and $H_2S$ in a fractionator into at least an overhead stream containing the naphtha and $H_2S$ and a bottoms stream, and introducing the overhead stream from the fractionator into a separator to form a naphtha stream substantially free of $H_2S$ and an overhead stream containing $H_2S$.

Another aspect of the invention is an apparatus for making naphtha. In one embodiment, the apparatus includes a hydroprocessing zone having an inlet and an outlet. The inlet of a stripper column is in fluid communication with the outlet of the hydroprocessing zone. The inlet of the stripping fractionator is in fluid communication with the bottoms outlet of the stripper column. The apparatus includes a separator having an inlet, a product outlet, and an overhead outlet. The inlet of the separator is in fluid communication with the overhead outlet of the stripping fractionator.

DETAILED DESCRIPTION OF THE INVENTION

By installing a separator, including but not limited to, vacuum dryers or coalescers, on the naphtha overhead stream from the fractionator column to the product line, the $H_2S$ can be removed, and the naphtha can be made substantially free of $H_2S$. By "naphtha," we mean C5 hydrocarbons up to hydrocarbons having a boiling point of about 150° C. (i.e., hydrocarbons having a boiling point in the range of about 30° C. to about 150° C.). By "substantially free of $H_2S$", we mean the $H_2S$ content is undetectable by ASTM test method UOP 163 and the naphtha passes the Doctor Test, ASTM D4952. This eliminates the need for the caustic/sand filter arrangement or the downstream stripper/stabilizer. In some embodiments where the separator is a vacuum dryer, the liquid portion of the vacuum dryer overhead can be recycled back to the stripper.

The solubility of $H_2S$ in steam is quite high in columns which are steam stripped. Since this "sour water" remains in the overhead naphtha and is not totally removed, the naphtha may test positive for $H_2S$. In this case, the separator can be a coalescer which is installed to remove the water, and hence the $H_2S$.

The selection of the type of separator, such as a vacuum dryer or a coalescer, depends on the amount of $H_2S$ slipping through into the naphtha overhead stream and how low the moisture content needs to be to meet the Doctor Test.

Figure 1:
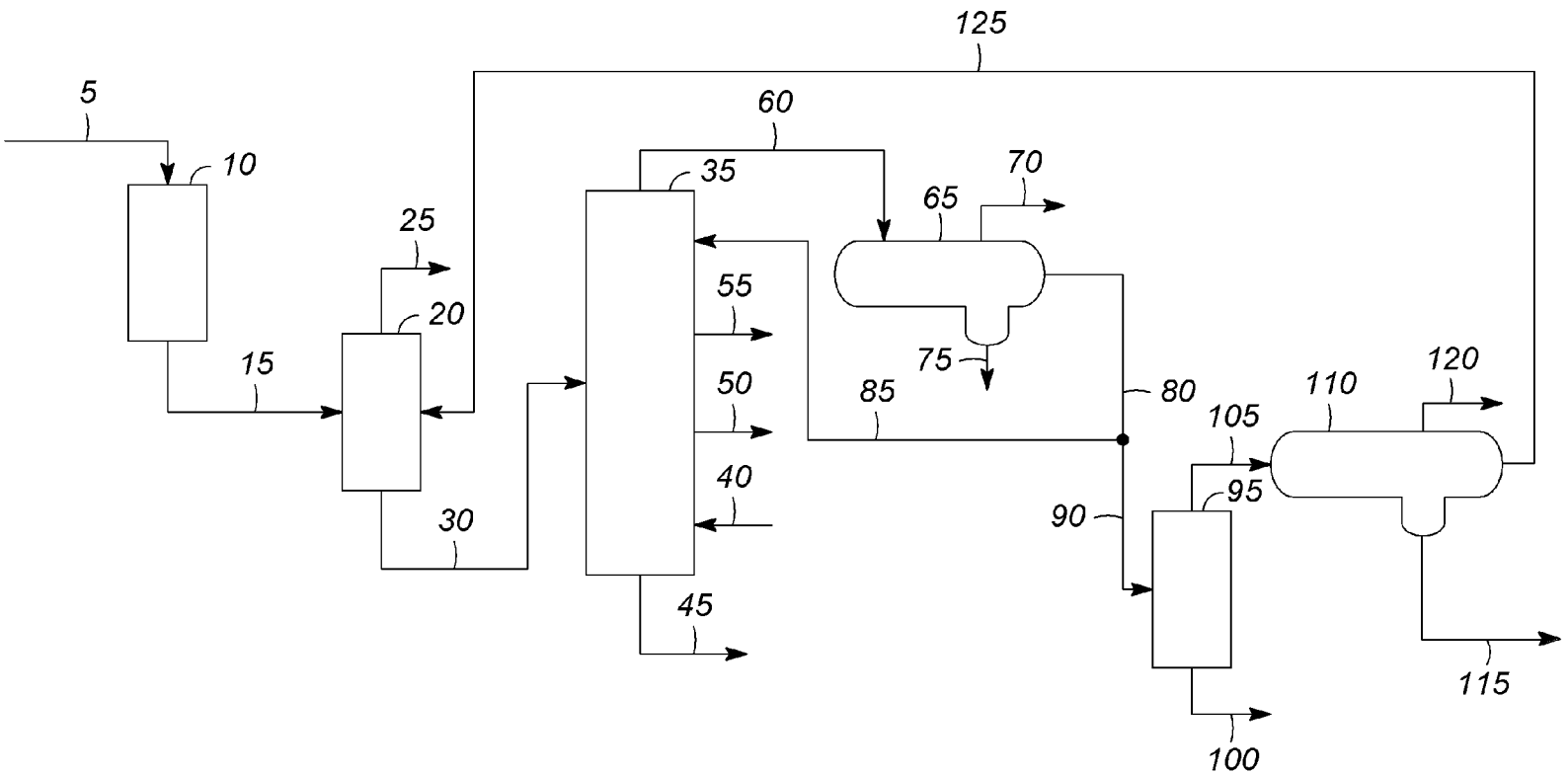
FIG. 1 illustrates one embodiment of a process utilizing the present invention.

FIG. 1 illustrates one embodiment of a process utilizing the present invention. The feed 5 can be any hydrocarbon feed stream(s) predominantly boiling between about 240° C. and about 600° C. The feed 5 is hydroprocessed in the hydroprocessing zone 10. The effluent 15 can be subjected to one or more separation processes where at least a portion of the gas is removed and the remaining liquid/gas effluent proceeds, as is known in the art (not shown), if desired. The remaining effluent 15 from the hydroprocessing zone 10 is sent to a stripper column 20, where it is separated into a stripper overhead stream 25 containing at least one of light naphtha, light petroleum gas, light hydrocarbons, and $H_2S$, and a stripper bottoms stream 30 containing light and heavy naphtha, other hydrocarbons heavier than naphtha (e.g., kerosene, diesel, vapor gas oil, unconverted oil, and the like, depending on the feed and the hydroprocessing zone), and $H_2S$. The stripper bottoms stream 30 is sent to a fractionator 35. Stripping medium 40 is introduced into the fractionator 35. The stripper bottoms stream 30 is separated into a fractionator bottoms stream 45 containing unconverted oil, a heavy gas oil (HGO) stream 50, a light gas oil (LGO) stream 55, and a fractionator overhead stream 60. The HGO stream 50 and LGO stream 55 can be further processed and/or recovered, if desired.

Figure 2:
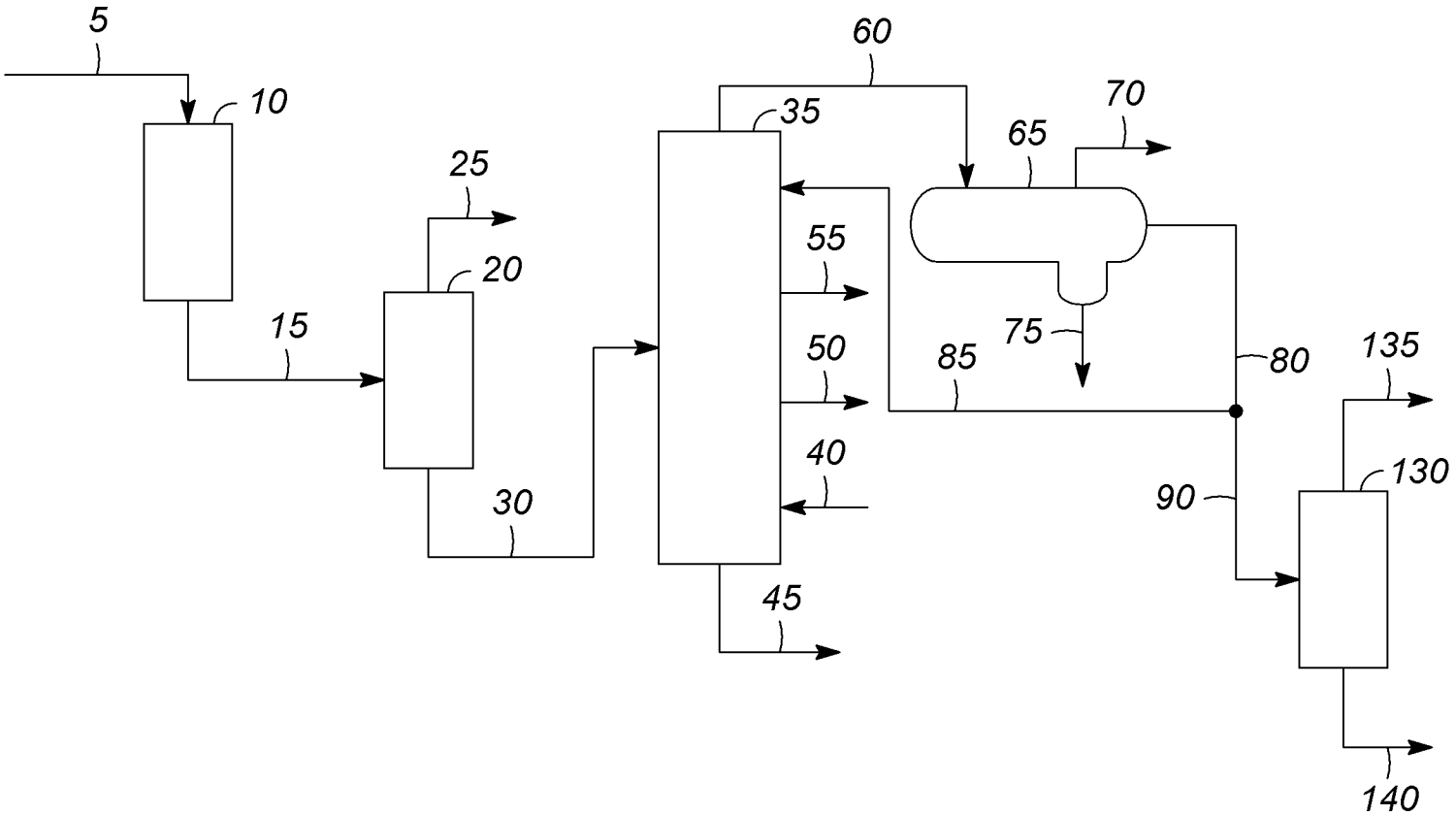
FIG. 2 illustrates another embodiment of a process utilizing the present invention.

The fractionator overhead stream 60 contains primarily naphtha, and $H_2S$. Although most of the $H_2S$ is removed in the stripper column 20, the remaining $H_2S$ is concentrated in the fractionator overhead stream 60. Fractionator overhead stream 60 is sent to receiver 65 wherein it is separated into a receiver overhead gas stream 70, a sour water stream 75, and a liquid naphtha stream 80. The liquid naphtha stream 80 can contain small amounts of water and $H_2S$. The liquid naphtha stream 80 is split into a reflux stream 85, which is sent back to the fractionator column 35, and stream 90, which is sent to a separator. Suitable separators include, but are not limited to, a vacuum dryer 95, as shown in FIG. 1, or a coalescer 130, as shown in FIG. 2. Sufficient $H_2S$ is removed in the vacuum dryer 95 so that the naphtha in product stream 100 is substantially free of $H_2S$. An overhead stream 105 from the vacuum dryer 95 contains $H_2S$.

The vacuum dryer is operated under vacuum. The level of vacuum is not limited; however, it is desirably the lowest level that will remove sufficient $H_2S$ so that the naphtha in product stream 100 is substantially free of $H_2S$. The vacuum dryer can be operated at any suitable temperature. The temperature of operation is related to the level of vacuum generated in the dryer (i.e., the higher the level of vacuum, the lower the temperature needs to be).

The vacuum dryer overhead stream 105 is sent to an ejector receiver 110, where it is separated into ejector stream 115, which is condensed steam, a non-condensible vapor stream 120, and a condensable stream 125. Ejector stream 115, non-condensible vapor stream 120, and condensable stream 125 will have some $H_2S$ in them. Condensable stream 125 can be recycled to the stripper column 20, if desired.

When steam is used as the stripping medium 40, a coalescer 130 could be used, as illustrated in FIG. 2. The coalescer 130 removes the water as stream 140 from the naphtha product 135. Because of the high solubility of $H_2S$ in water, the $H_2S$ would be removed with the water. Typical operating conditions for the coalescer include operating at the temperature of stream 90.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It should be understood that various changes may be made in the function and arrangement of elements described in an exemplary embodiment without departing from the scope of the invention as set forth in the appended claims.

What is claimed is:

1. A method of making naphtha substantially free of $H_2S$ comprising:

stripping an incoming stream containing naphtha and a level of $H_2S$ that is less than about 10 wppb in a fractionator into at least a fractionator overhead stream containing the naphtha and $H_2S$ and a bottoms stream;

separating the fractionator overhead stream into overhead gas stream and a fractionator overhead liquid naphtha stream having a level of $H_2S$ that is at least about 50 wppm; and introducing the fractionator overhead liquid naphtha stream into a separator comprising a coalescer or a vacuum dryer to form a naphtha stream substantially free of $H_2S$ and a stream containing $H_2S$.

2. The method of claim 1 wherein the incoming stream containing naphtha and $H_2S$ is produced by stripping a hydroprocessed product in a stripper column into a stripper column overhead stream and the incoming stream containing the naphtha and $H_2S$.

3. The method of claim 2 wherein the hydroprocessed product is produced by reacting a hydrocarbon stream having a boiling point between about 240° C. and about 600° C. in a hydroprocessing zone under hydroprocessing conditions.

4. The method of claim 2 wherein the separator is a vacuum dryer and further comprising introducing a portion of the vacuum dryer overhead stream into the stripper column.

5. The method of claim 2 wherein the stripper column overhead stream comprises at least one of light naphtha, light petroleum gas, light hydrocarbons, and $H_2S$.

6. The method of claim 1 wherein the incoming stream comprises a mixture of light naphtha, heavy naphtha, and heavy hydrocarbons.

7. The method of claim 1 further comprising recovering the naphtha stream substantially free of $H_2S$.

8. The method of claim 1 wherein the separator is a coalescer, wherein stripping the incoming stream containing naphtha and $H_2S$ comprises steam stripping the incoming stream containing naphtha and $H_2S$, and wherein the fractionator overhead liquid naphtha stream is introduced into the coalescer.

9. The method of claim 1 wherein stripping the incoming stream containing naphtha and $H_2S$ in the fractionator into at least the fractionator overhead liquid naphtha stream containing the naphtha and $H_2S$ and the bottoms stream further comprises stripping the incoming stream containing naphtha and $H_2S$ in the fractionator into at least the overhead stream containing the naphtha and $H_2S$ and the bottoms stream, a light gas oil stream, and a heavy gas oil stream.

10. A method of making naphtha substantially free of $H_2S$ comprising:

reacting a hydrocarbon stream having a boiling point between about 240° C. and about 600° C. in a hydroprocessing zone under hydroprocessing conditions to form a hydroprocessed product;

stripping the hydroprocessed product in a stripper column into a stripper column overhead stream and a stripper column bottoms stream containing naphtha and a level of $H_2S$ that is less than about 10 wppb;

stripping the stripper column bottoms stream in a fractionator into at least a fractionator overhead stream containing the naphtha and $H_2S$ and a fractionator bottoms stream;

separating the fractionator overhead stream into overhead gas stream and a fractionator overhead liquid naphtha stream having a level of $H_2S$ that is at least about 50 wppm; and introducing the fractionator overhead liquid naphtha stream into a separator to form a naphtha stream substantially free of $H_2S$ and a stream containing $H_2S$.

11. The method of claim 10 further comprising recovering the naphtha stream substantially free of $H_2S$.

12. The method of claim 10 wherein the separator is a vacuum dryer and further comprising introducing a portion of the vacuum dryer overhead stream into the stripper column.

13. The method of claim 10 wherein the stripper column bottoms stream comprises a mixture of light naphtha, heavy naphtha, and heavy hydrocarbons.

14. The method of claim 10 wherein stripping the stripper column bottoms stream in the fractionator into at least the fractionator overhead liquid naphtha stream containing the naphtha and $H_2S$ and the fractionator bottoms stream further comprises stripping the stripper column bottoms stream in the fractionator into at least the fractionator overhead liquid naphtha stream containing the naphtha and $H_2S$ and the fractionator bottoms stream, a light gas oil stream, and a heavy gas oil stream.

15. The method of claim 10 wherein the separator is a coalescer, wherein stripping the incoming stream containing naphtha and $H_2S$ comprises steam stripping the incoming stream containing naphtha and $H_2S$, and wherein the fractionator overhead liquid naphtha stream is introduced into the coalescer.

* * * * *